US010961745B2

(12) United States Patent
Borenstein

(10) Patent No.: US 10,961,745 B2
(45) Date of Patent: Mar. 30, 2021

(54) KEY COVER

(71) Applicant: David Frank Borenstein, Pembroke (CA)

(72) Inventor: David Frank Borenstein, Pembroke (CA)

(73) Assignee: David Frank Borenstein, Pembroke (CA)

( * ) Notice: Subject to any disclaimer, the term of this patent is extended or adjusted under 35 U.S.C. 154(b) by 0 days.

(21) Appl. No.: 16/720,089

(22) Filed: Dec. 19, 2019

(65) Prior Publication Data

US 2020/0123805 A1 Apr. 23, 2020

Related U.S. Application Data

(63) Continuation of application No. 16/172,979, filed on Oct. 29, 2018, now Pat. No. 10,519,693, which is a continuation of application No. 15/631,022, filed on Jun. 23, 2017, now Pat. No. 10,138,655.

(60) Provisional application No. 62/493,143, filed on Jun. 24, 2016.

(51) Int. Cl.

| | |
|---|---|
| ***E05B 19/24*** | (2006.01) |
| ***A47G 29/10*** | (2006.01) |
| ***E05B 19/04*** | (2006.01) |

(52) U.S. Cl.

CPC ..... *E05B 19/24* (2013.01); *A47G 29/10* (2013.01); *E05B 19/04* (2013.01)

(58) Field of Classification Search

CPC ..... E05B 19/04; E05B 19/0045; E05B 19/24; A47G 29/10

USPC ..... 70/408, 413; 211/11; 312/234, 245

See application file for complete search history.

(56) References Cited

U.S. PATENT DOCUMENTS

| | | | |
|---|---|---|---|
| 1,669,115 | A | 5/1928 | Anakin |
| 2,932,107 | A | 4/1960 | Scipione |
| 2,982,041 | A | 5/1961 | Kent |
| 3,123,926 | A | 3/1964 | Jacobson |
| 3,827,774 | A | 8/1974 | Reiling, Jr. |
| 3,841,120 | A | 10/1974 | Gartner |
| 4,236,331 | A | 12/1980 | Mattson |
| 4,349,975 | A | 9/1982 | Chubb |
| 4,936,896 | A | 6/1990 | Takatsuka |
| 5,038,590 | A | 8/1991 | Sawyer et al. |
| 5,083,662 | A | 1/1992 | Bishop |

(Continued)

FOREIGN PATENT DOCUMENTS

| | | | | |
|---|---|---|---|---|
| CN | 201924670 U | | 8/2011 | |
| EP | 2660411 | * | 2/2013 | ..... E05B 19/04 |
| WO | 2016058101 A1 | | 4/2016 | |

OTHER PUBLICATIONS

USPTO, U.S. Office Action relating to U.S. Appl. No. 15/631,022, dated Oct. 19, 2017.

(Continued)

*Primary Examiner* — Suzanne L Barrett

(74) *Attorney, Agent, or Firm* — Rowand LLP

(57) ABSTRACT

A cover for a key is disclosed. The cover includes: a first wall; a second wall opposite to the first wall; and an outer wall extending between the first wall and the second wall, the outer wall defining a pair of slots extending therethrough, the slots being positioned opposite to each other on the outer wall, wherein the first wall, the second wall, and the outer wall define a closed chamber for receiving a bow of the key and an opening to the chamber.

19 Claims, 4 Drawing Sheets

FIG. 3A

(56) References Cited

U.S. PATENT DOCUMENTS

| | | | |
|---|---|---|---|
| 5,113,602 | A | 5/1992 | Levine et al. |
| 5,141,300 | A | 8/1992 | Ciesla |
| 5,181,605 | A | 1/1993 | Bishop et al. |
| 5,181,927 | A | 1/1993 | Song |
| 5,621,936 | A | 4/1997 | Penaligon |
| 5,819,564 | A | 10/1998 | Watanuki |
| 6,367,299 | B1 | 4/2002 | Janssen et al. |
| 6,550,298 | B1 | 4/2003 | Su |
| 6,604,308 | B1 | 8/2003 | Robles |
| 6,729,723 | B2 | 5/2004 | Xie |
| 6,928,845 | B2 | 8/2005 | Howard et al. |
| 6,951,122 | B1 | 10/2005 | Jheng |
| 7,047,776 | B2 | 5/2006 | Blake |
| 7,360,383 | B1 | 4/2008 | Chang |
| 8,403,011 | B1 | 3/2013 | McKendry |
| 8,464,447 | B2 | 6/2013 | Pemberton |
| 9,315,321 | B2 | 4/2016 | Browne et al. |
| 9,584,639 | B2 | 2/2017 | Slaby et al. |
| 10,138,655 | B2 | 11/2018 | Borenstein |
| 2004/0079125 | A1 | 4/2004 | Morehart et al. |
| 2004/0093920 | A1 | 5/2004 | Howard |
| 2005/0072198 | A1 | 4/2005 | Casellini et al. |
| 2016/0369526 | A1 | 12/2016 | Ho |
| 2017/0234034 | A1 | 8/2017 | Borenstein |

OTHER PUBLICATIONS

USPTO, U.S. Final Office Action relating to U.S. Appl. No. 15/631,022, dated Apr. 24, 2018.

USPTO, U.S. Final Office Action relating to U.S. Appl. No. 15/631,022, dated Jun. 5, 2018.

USPTO, U.S. Notice of Allowance relating to U.S. Appl. No. 15/631,022, dated Aug. 29, 2018.

* cited by examiner

KEY COVER

RELATED APPLICATION

This application claims priority to U.S. Provisional Patent Application No. 62/493,143 filed on Jun. 24, 2016 and is a continuation of U.S. patent application Ser. No. 16/172,979 filed on Oct. 29, 2018 which was a continuation of U.S. patent application Ser. No. 15/631,022 filed on Jun. 23, 2017. The contents of these prior applications are hereby incorporated by reference.

TECHNICAL FIELD

The present disclosure relates to physical keys and, in particular, to key covers suitable for use with different types of keys.

BACKGROUND

A key cap provides a protective cover for the bow, or head, of a key. When the bow of a key is inserted into a key cap, the key cap covers the outer surface of the bow and retains the bow (for example, by friction fit), leaving the blade of the key to be exposed outside of the key cap. Keys can be differentiated by fitting their bows with key caps of varying shapes, colours and/or designs. Key caps can also provide improved grip of the covered key and display information for identifying the key.

The shape of a key's bow can be useful in identifying the type of the key. Various different bow shapes for common key types are known. A popular type of key is the "SC1" key, which is compatible with, for example, a Schlage® five-pin, "C" keyway. An SC1 key has a bow that is generally wider than the bows of other common key types, such as "KW1" (Kwikset) and "WR5" (Weiser). As a consequence, a key cap for covering a KW1 key or a WR5 key may not be suitable for use with an SC1 key. For example, the bow of an SC1 key may not fit in a smaller key cap for other common key types. Even if the SC1 bow can be fitted in the smaller key cap, the wider SC1 bow may cause the key cap material to experience an unusual amount of stretching, with the resulting stress eventually causing the key cap to tear. Conversely, a key cap which is appropriately sized to cover an SC1 bow may not provide a secure friction fit for keys that have narrower bows.

U.S. Pat. No. 6,928,845 ('845) discloses a universal key cap that fits around different edged bows of various common house keys. The key cap in '845 includes a hollow chamber for receiving the bow of a key and edged segments molded on an inner surface of the chamber that register with at least one of the edges of the key bow. The edged segments of the key cap are designed to accommodate the varied geometry of the key bows of a plurality of common key types. As a result, the key cap of '845 includes a chamber having a complex internal make-up defined by multiple edges and edged corners. In particular, the chamber of the key cap is designed to be wide enough to house the bow of SC1 keys and, accordingly, the key cap has a large width, which may result in undesirable bulk.

BRIEF DESCRIPTION OF DRAWINGS

Reference will now be made, by way of example, to the accompanying drawings which show example embodiments of the present application and in which.

Like reference numerals are used in the drawings to denote like elements and features.

DETAILED DESCRIPTION OF EXAMPLE EMBODIMENTS

Figure 1A:
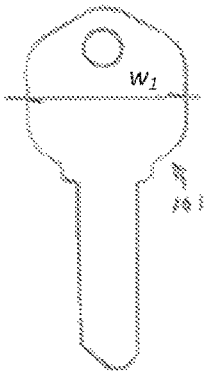
FIGS. 1A-1D show elevational front views of KW1, WR5, Y1, and SC1 keys, respectively.
Figure 1B:
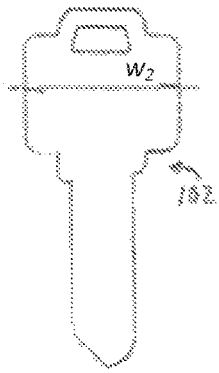
Figure 1C:
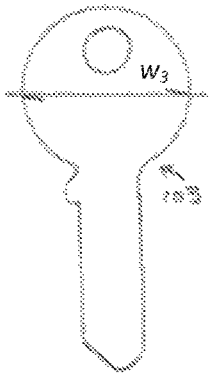
Figure 1D:
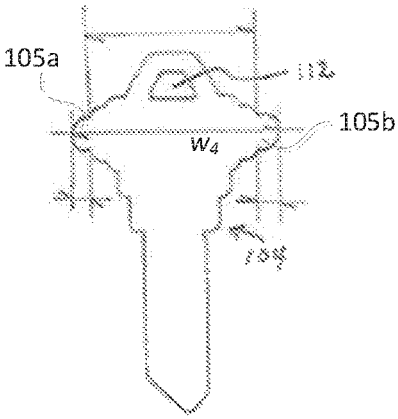

In an aspect, the present disclosure describes a key cover. The key cover includes a first wall, a second wall opposite to the first wall, and an outer wall extending between the first wall and the second wall. The outer wall defines a pair of slots which extend through the outer wall and which are positioned opposite to each other on the outer wall. The first wall, the second wall, and the outer wall together define a closed chamber for receiving a bow of the key as well as an opening to the chamber.

In an aspect, a cover for a key is described. The cover for the key may include a first wall and a second wall opposite to the first wall. The cover for the key may further include an outer wall extending between the first wall and the second wall. The outer wall may define a pair of slots extending therethrough. The slots may be positioned opposite to each other on the outer wall. The slots may be sized to interlock with lateral bow tips of an SC1 key. The first wall, the second wall, and the outer wall may define a closed chamber and an opening to the closed chamber.

In at least some implementations, the slots may be positioned on opposite sides of a plane which extends orthogonally through the first and second walls and which bisects the outer wall.

In at least some implementations, a height of at least one of the slots is between 4 and 5 millimeters. In at least some implementations, a height of at least one of the slots is between 4 and 6 millimeters.

In at least some implementations, the cover may be a non-hinged cover.

In at least some implementations, the cover may be adapted to hold the key by secure friction fit.

In at least some implementations, a side edge of the first wall, a second side edge of the second wall, and end surfaces of the outer wall together form a rim which defines the opening.

In at least some implementations, a length of the opening may be between 15 millimeters and 40 millimeters.

In at least some implementations, the first wall may define a first cavity extending partially from an exterior surface of the first wall to an opposite interior surface of the first wall.

In at least some implementations, the first cavity may be cylindrical.

In at least some implementations, the cover may include a first magnet inserted in the first cavity.

In at least some implementations, the first magnet may be a ring magnet.

In at least some implementations, the first magnet may be a disk magnet.

In at least some implementations, the first wall may define a first key ring aperture extending therethrough and the second wall may define a second key ring aperture extending therethrough. The first key ring aperture may be in alignment with the second key ring aperture.

In at least some implementations, the second wall may define a second cavity extending partially from an exterior surface of the second wall to an opposite interior surface of the second wall.

In at least some implementations, the cover may include a second magnet inserted in the second cavity.

In at least some implementations, the slots may be positioned in spaced relation to respective ends of the outer wall adjacent the opening such that received lateral bow tips fit through the slots when the cover is slipped over an SC1 key.

In at least some implementations, the slots may be rectangular slits.

In at least some implementations, the slots may be sized to interlock with lateral bow tips of an SC1 key having lateral bow tips of approximately 2 millimeters in length and approximately 0.75 millimeters in width.

In at least some implementations, the opening to the closed chamber may be for receiving a bow of the key to insert the key in the cover, and once inserted, to allow for protrusion of a blade of the key from the cover.

In at least some implementations, the cover may be constructed from rubber.

Other example embodiments of the present disclosure will be apparent to those of ordinary skill in the art from a review of the following detailed descriptions in conjunction with the drawings.

FIGS. 1A to 1D illustrate keys of several common key types, including a KW1 key 101, WR5 key 102, Y1 key 103, and SC1 key 104. Generally, the standard widths, $w_1$, $w_2$, and $w_3$ of the bows for keys 101, 102, and 103, respectively, are each equal to 23 millimeters. The bow width, $w_4$, of key 104 is 27 millimeters, which is greater than the widths of the other key types by the sum of the widths of lateral bow tips 105*a* and 105*b*.

In the present application, the terms "key cap" and "key cover" will be used interchangeably.

Reference is now made to FIGS. 2A to 2D, which show an example key cover 200. The key covers of the present disclosure, such as key cover 200, may be used to cover the bow portion of various different types of keys, such as those illustrated in FIGS. 1A to 1D. In particular, the key covers may be slipped over the bow of a key to provide cover for the key. The key covers may be re-used with different keys simply by removing the cover from one key and slipping it over the bow of another key. The key covers may be constructed from materials such as polyvinyl chloride (PVC), thermoplastic resin, rubber, silicon rubber, neoprene, or a combination of materials, including metallic components.

The key cover 200 includes a first wall 220 and a second wall 221 opposite to the first wall 220. In at least some embodiments, the first wall 220 and the second wall 221 are generally planar and in parallel spaced relation to each other. For example, a distance between the first wall 220 and the second wall 221 may be between 0.75 and 12 millimeters. For key covers that are used for covering larger keys (e.g. automotive keys), the distance between the first wall 220 and the second wall 221 may be between 5 and 12 millimeters. Each of the first wall 220 and the second wall 221 includes an exterior surface, an interior surface opposite to the exterior surface, and an outer periphery having at least a side edge 210 which forms an end surface of the wall. The first wall 220 and the second wall 221 may have the same thickness (i.e. distance between the exterior and interior surfaces of a wall), or one of the walls may be thicker than the other. The key cover 200 also includes an outer wall 202 which extends between the first wall 220 and the second wall 221. The outer wall 202 terminates at a first end 250 and a second end 251. The first wall 220, the second wall 221, and the outer wall 202 together define a closed chamber 205 for receiving the bow of a key. In particular, the chamber 205 is defined by an interior surface 222 of the first wall 220, an interior surface 223 of the second wall 221, and an interior surface 224 of the outer wall 202. The outer wall 202 extends at least partially along a periphery of the first wall 220 and the second wall 221, respectively, and joins the walls 220 and 221 together to form a complete cover over the bow of a key.

The first wall 220, the second wall 221, and the outer wall 202 also define an opening 206 to the chamber 205. In at least some embodiments, the opening 206 may be an aperture located on one side of the key cover 200. More generally, the opening 206 may form an open end of the key cover 200, defined, in part, by portions of the periphery of the first wall 220 and the second wall 221 that are not joined by the outer wall 202. The opening 206 facilitates insertion (and removal) of a key bow into (and from) the chamber 205. Accordingly, the opening 206 is dimensioned to allow smooth ingress and egress of a key bow. For example, in some embodiments, the length of the opening 206 may range between 15 and 40 millimeters. For key covers that are used for covering larger keys (e.g. automotive keys), the length of the opening 206 may be between 25 and 40 millimeters. In another embodiment, the first wall 220, the second wall 221, and the outer wall 202 may define a second opening (not shown in diagrams) that is located opposite to the opening 206. The second opening provides another aperture through which a key can be inserted into the body of key cover 200.

In particular, by having two separate, opposite openings in the key cover 200, the key bow may be inserted into the key cover 200 in two different ways. The bow end (i.e. the end of the key furthest from the blade) of the key may be inserted/forced through the opening 206 (or the second opening) until the bow is positioned/fit inside the chamber 205. Alternatively, the blade end (i.e. the end opposite to the bow end) of the key may be inserted through the second opening (or opening 206) and drawn out through the opening 206 (or the second opening) until the bow is positioned/fit inside the chamber 205.

Figure 2A:
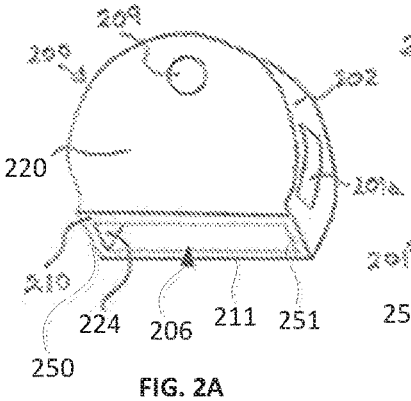
FIGS. 2A and 2B show perspective views of an example key cover in accordance with example embodiments of the present disclosure.
Figure 2B:
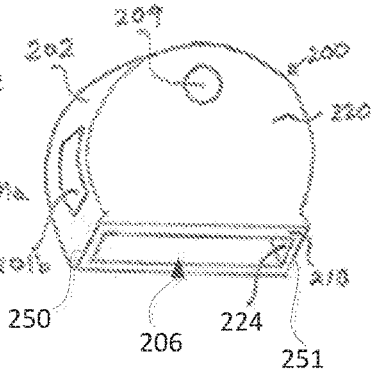
Figure 2C:
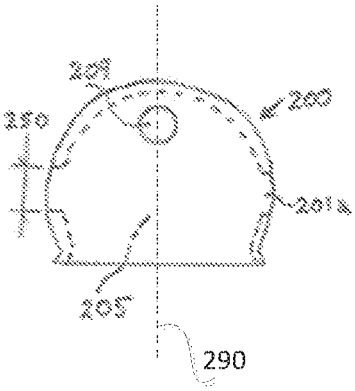
FIG. 2C shows a front view of the example key cover of FIGS. 2A and 2B.
Figure 2D:
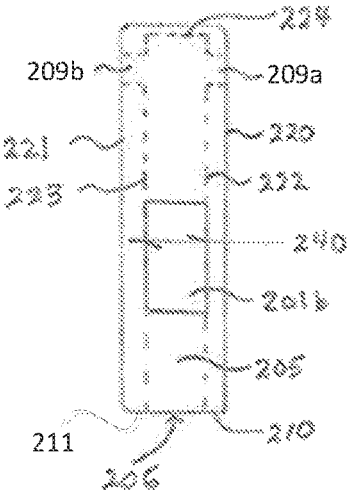
FIG. 2D shows a side view of the example key cover of FIGS. 2A and 2B.

The outer wall 202 defines a pair of slots 201*a* and 201*b* which extend through the outer wall 202. In particular, the slots 201*a* and 201*b* are in communication with the chamber 205. The slots 201*a* and 201*b* are positioned opposite to each other on the outer wall 202. As shown in FIGS. 2A and 2B, in at least some embodiments, the outer wall 202 is curved to correspond to the curved periphery of the first wall 220 and the second wall 221. In some other embodiments, the outer wall 202 may include two or more sidewalls joined together, with each sidewall extending between the first wall 220 and the second wall 221, to form a continuous, closed boundary of the key cover 200. More generally, the outer wall 202 defines two "sides", where the "sides" correspond to the opposing sides of a plane (shown in FIG. 2C by axis 290) which extends orthogonally through the first wall 220 and the second wall 221 and which bisects the outer wall 202. Alternatively defined, a first "side" of the outer wall 202 may refer to those points along the outer wall 202 that are closer to the first end 250 and a second opposite "side" of the outer wall 202 may refer to the points along the outer wall 202 that are closer to the second end 251. The slots 201*a* and 201*b* are thus positioned on opposite sides of the outer wall 202. In some embodiments, the slots 201*a* and 201*b* may be equidistant from the respective ends 250 and 251, respectively, along the outer wall 202.

The slots 201*a* and 201*b* defined on the outer wall 202 are positioned to receive the lateral bow tips 105*a* and 105*b* of an SC1 key bow through the slots when the key bow is inserted into and retained in the chamber 205. For example, the slots 201*a* and 201*b* may be located in spaced relation to the ends 250 and 251, respectively, along the outer wall 202 such that the lateral bow tips 105*a* and 105*b* fit through the slots when the key cover 200 is slipped over an SC1 key 104. The placement of these slots on the outer wall 202 allows the lateral bow tips of an SC1 key 104 to be exposed through the key cover 200, as shown in FIG. 3B. In this way, a smaller key cover that is suitable for common key types such as KW1 and WR5 may also be used with a larger SC1 key, without the SC1 key exerting unsustainable pressure on the key cover body and causing permanent stretching or tearing of the key cover.

The dimensions of the slots 201*a* and 201*b* are appropriate for receiving the lateral bow tips of an SC1 key. For example, one or both of the slots may have a width of at least 0.75 millimeters and a length of at least 2 millimeters. In some embodiments, the widths of slots 201*a* and 201*b* may be equal to the width of opening 206. In FIGS. 2A and 2B, the slots 201*a* and 201*b* are formed as rectangular slits on the outer wall 202; however, various different shapes (e.g. square, oval, or triangular slits, etc.) for the slots may be possible.

In at least some embodiments, the opening 206 of the key cover 200 is defined by a rim formed by edges of the first wall 220, the second wall 221, and the outer wall 202. For example, as illustrated in FIGS. 2A and 2B, a first side edge 210 of the first wall 220, a second side edge 211 of the second wall 221, and end surfaces at ends 250 and 251 of the outer wall 202 may together form a rim which defines the opening 206. In particular, the first side edge 210, the second side edge 211, and end surfaces of the outer wall 202 may be co-planar and define a rim delimiting the boundaries of the opening 206.

The key cover 200 may also include a key ring aperture 209 for receiving a key ring. In at least some embodiments, the first wall 220 may define a first key ring aperture 209*a* extending through the first wall 220 and the second wall 221 may define a second key ring aperture 209*b* extending through the second wall 220, such that the first key ring aperture 209*a* is in alignment with the second key ring aperture 209*b*. For example, the key ring apertures 209*a* and 209*b* may be cylindrical bores in the first wall 220 and the second wall 221, respectively. The key ring apertures may be located on their respective walls such that they are both aligned with a corresponding aperture on the bow of a key being covered by the key cover 200. For example, since the locations of the key ring aperture and lateral bow tips on a standard SC1 key may be known, the slots 201*a* and 201*b* as well as the key ring apertures 209*a* and 209*b* can be placed at appropriate positions on the body of the key cover 200 of FIG. 3A.

Figure 3A:
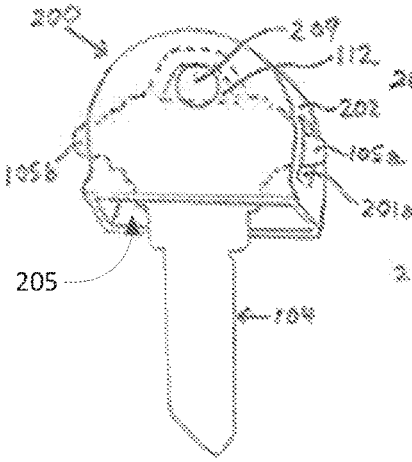
FIG. 3A shows a perspective view of an example key cover with an SC1 key blank inserted therein.
Figure 3B:
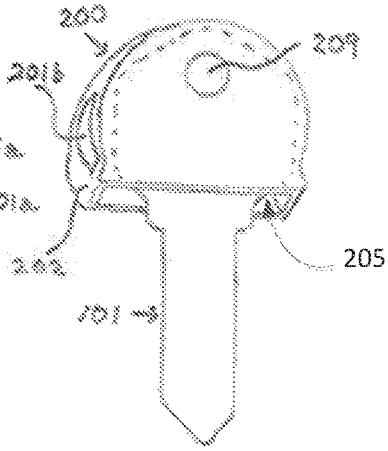
FIG. 3B shows a perspective view of an example key cover with a KW1 key blank inserted therein.

FIGS. 3A and 3B show an SC1 key 104 and a KW1 key 101, respectively, that are partially covered by key cover 200. As shown in FIG. 3B, the bow of the KW1 key 101 may be retained in the chamber 205 of the key cover 200 by a friction fit, preventing the key bow from being unintentionally dislodged from the chamber 205. For example, the distance of separation between the first wall 220 and the second wall 221 and the width of chamber 205 may be such that the bow of key 101 fits snugly between the walls. As another example, the interior surfaces 222, 223 and 224 of the first wall 220, second wall 221, and outer wall 202, respectively, may cooperate to define an internal geometry (edges, edged corners, protrusions, etc.) of the chamber 205 that allows the bow of key 101 to form a friction fit within the chamber 205. Key bows having similar width (e.g. WR5, etc.) as that of KW1 key 101 may be fitted into the chamber 205 by a similar mechanism. As shown in FIG. 2A, the bow of SC1 key 104 may also be retained in the chamber 205 by means of a friction fit with the interior surfaces of the chamber 205. Additionally, the SC1 key 104 may be secured to the key cover 200 when the bow of key 104 is inserted into the chamber 205 and the lateral bow tips 105*a* and 105*b* are passed through and interlock with the slots 201*a* and 201*b*, respectively.

Figure 4A:
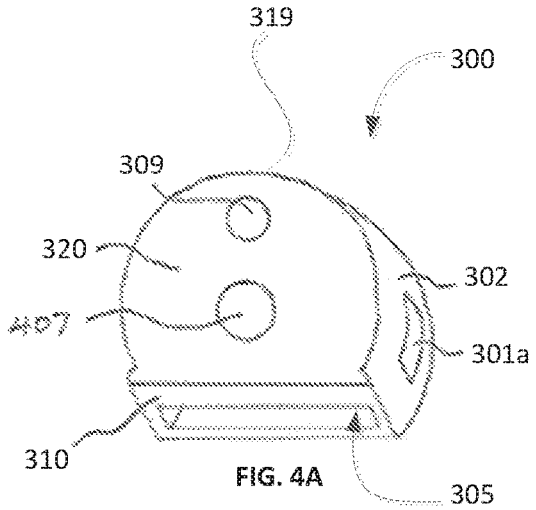
FIG. 4A shows a perspective view of another example key cover in accordance with example embodiments of the present disclosure.
Figure 4B:
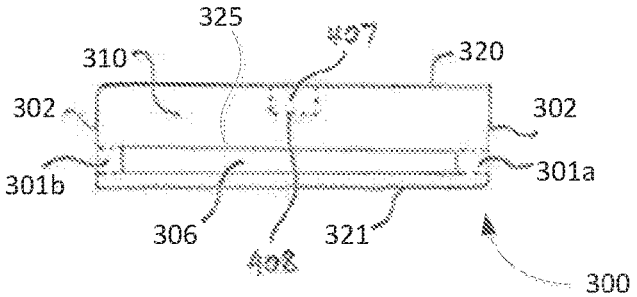
FIG. 4B shows a bottom view of the example key cover of FIG. 4A.
Figure 4C:
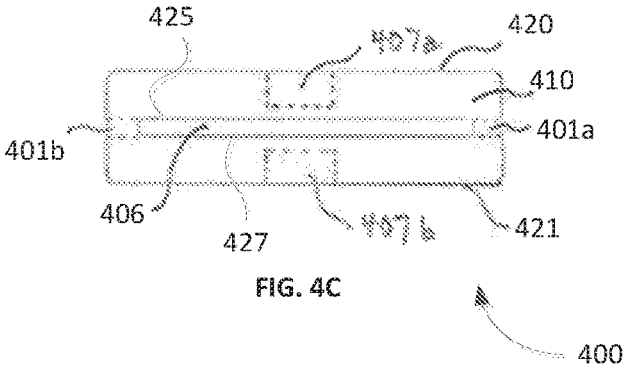
FIG. 4C shows a bottom view of another example key cover in accordance with example embodiments of the present disclosure.

Reference is now made to FIGS. 4A-4C which show example key covers 300 and 400 in accordance with embodiments of the present disclosure. The components 301*a*, 301*b*, 302, 310, 320, 321, and 306 correspond to similar components 201*a*, 201*b*, 202, 210, 220, 221, and 206, respectively, of key cover 200. The key cover 300 of FIG. 4A includes a cavity 407 defined on the first wall 320. The cavity 407 extends at least partially between the exterior surface of the first wall 320 and the opposite interior surface of the first wall 320. For example, the cavity 407 may extend from the exterior surface towards the interior surface of the first wall 320 such that it is exposed to and accessible from the exterior of the key cover 300. As another example, the cavity 407 may extend from the interior surface towards the exterior surface of the first wall 320 such that it is exposed to and communicates with the chamber 305. As yet another example, the cavity 407 may be completely encased in the first wall 320; that is, the cavity 407 may be located between the exterior and interior surfaces of the first wall 320 with neither end of the cavity 407 being exposed (i.e. the cavity 407 is close-ended, a magnet being installed during production/molding of the key cover). As shown in FIG. 4B, the cavity 407 may, in some embodiments, be a cylindrical, partial bore defined on the first wall 320. The cavity 407 does not, however, have to be cylindrical; other cross-sectional shapes (e.g. square, rectangular, triangular, etc.) may be suitable for the cavity 407. The cavity 407 does not extend all the way through the first wall 320 to the chamber 305. In particular, the base (or bottom surface) 408 of the cavity 407 is in spaced relation to the interior surface 325 of the first wall 320 which defines the geometry of chamber 305.

In at least some embodiments, the cavity 407 accommodates installation of a magnet therein, such that a magnetic field may be provided on at least one side of the key cover 300. A magnet (e.g. ring magnet, disk magnet, cylindrical magnet, etc.) can be installed in the cavity 407 as part of the assembly process for the key cover 300, or it may be manually inserted into the cavity 407 by a user of the key cover 300. The magnet may be sized such that it fits completely inside the cavity 407 and is flush (or near flush) with the exterior surface of the first wall 320. In some embodiments, the magnet can be retained in and secured to the cavity 407 by means of an adhesive (e.g. glue). For example, an adhesive may be applied to the walls and/or base of the cavity 407 prior to inserting the magnet in the cavity 407. Alternatively, a user may insert, into the cavity 407, a magnet (e.g. peel-and-stick type magnet) that includes an adhesive which is protected by a removable covering.

FIG. 4C shows another example key cover 400. The components 401*a*, 401*b*, 406, 410, 420, and 421 correspond to components 201*a*, 201*b*, 206, 210, 220, and 221 of key cover 200 shown in FIG. 2A. The key cover 400 includes two cavities, 407*a* and 407*b*, which are adapted to receive separate magnets. The cavity 407*a* is defined on the first wall 420 and the cavity 407*b* is defined on the second wall 421. Each of the cavities 407*a* and 407*b* extends partially between the exterior surface and the interior surface of its respective wall. Similar to the configuration in FIG. 4B, the base of each cavity is in spaced relation to the interior surface (i.e. 425 or 427) of its respective wall.

Figure 5A:
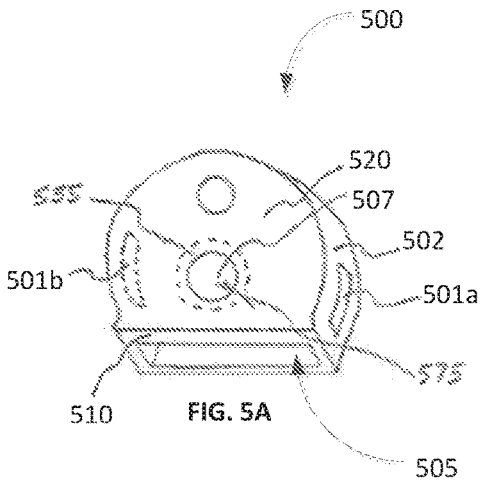
FIG. 5A shows a perspective view of another example key cover in accordance with example embodiments of the present disclosure.
Figure 5B:
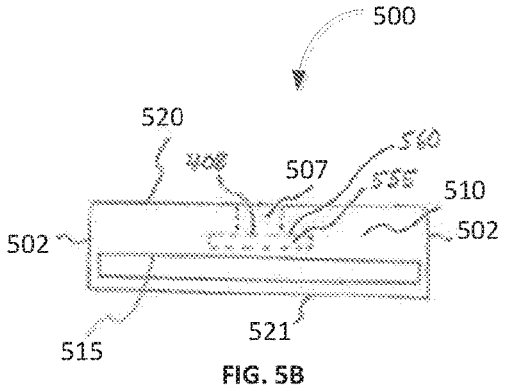
FIG. 5B shows a bottom view of the example key cover of FIG. 5A.
Figure 5C:
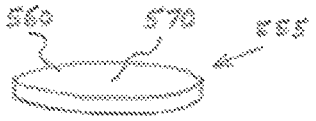
FIGS. 5C-5E show perspective views of example metallic plates suitable for embedding in an example key cover.
Figure 5D:
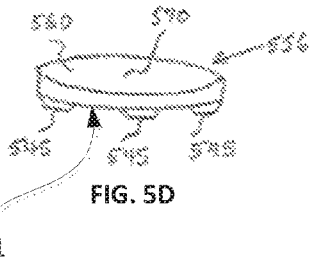
Figure 5E:
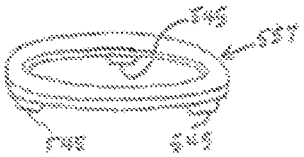

FIGS. 5A-5B show another example key cover 500. The components 501*a*, 501*b*, 507, 510, 520, and 521 correspond to components 201*a*, 201*b*, 407, 210, 220, and 221 of key covers 200 and 400 shown in FIGS. 2A and 4A. The key cover 500 includes a metallic plate 555 which is embedded in the first wall 520. The metallic plate 555 may be embedded, for example, during the injection molding process for forming the body of key cover 500. The metallic plate 555 is generally parallel to the interior surface of the first wall 520 and embedded between the base 408 of cavity 507 and the interior surface of the first wall 520. In particular, the metallic plate 555 is positioned at least partially within the cavity 507 and in spaced relation to the chamber 505. For example, the cavity 507 may be a bore extending from the exterior surface to the interior surface of the first wall 520 and the metallic plate 555 may be so positioned that at least a portion of a planar surface of the metallic plate 555 demarcates a closed end of the cavity 507. In some embodiments, the metallic plate 555 is positioned adjacent to the terminal end of cavity 507, i.e. plate 555 abuts the cavity 507. The metallic plate 555 may be a metallic disk, such as disk 555 or disk 556 shown in FIGS. 5C and 5D, respectively, or a metallic ring defining a central hole, such as ring 557 shown in FIG. 5E.

In at least some embodiments, a first planar surface, or end face, 560 of the metallic plate 555 forms the base 408 (i.e. terminal/closed end, or bottom wall) of cavity 507. In particular, the area of surface 560 of the metallic plate 555 is greater than a cross-sectional area of the cavity 507, and the metallic plate 555 is positioned such that the center 570 of surface 560 aligns with the central axis of cavity 507. The metallic plate 555 may thus provide an encased margin surrounding the circumference of the cavity 507. The embedded metallic plate 555 may enhance the magnetic pull force of an attached magnet that is secured directly to the metallic plate 555 within the cavity 507. The metallic plate 555 may also anchor an attached magnet and prevent it from being unintentionally dislodged from the cavity 507, since the encased margin of the metallic plate 555 can prevent a magnet from being pulled out of the cavity 507. Furthermore, attaching a magnet directly to a planar surface of a metallic surface, such as surface 560 of plate 555, may provide a reliable long-term bond, as compared to the attachment of a magnet to a polymer material. A magnet may be attached to the plate 555, for example, by using an adhesive (e.g. glue) applied to one or both of the magnet and the plate 555.

Figure 5F:
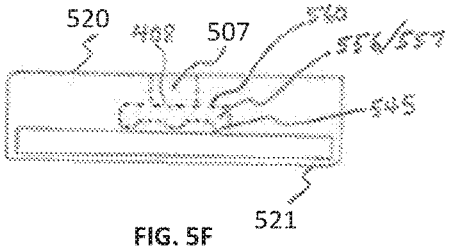
FIG. 5F shows a bottom view of another example key cover in accordance with example embodiments of the present disclosure.

The metallic plate 555 may take various different forms. For example, the metallic plate 555 may be a disk, such as disk 556, having a plurality of protrusions/projections 545 on at least one planar surface 561 (e.g. the surface of plate 555 that is opposite to the surface 560). The protrusions 545 extend from the planar surface 561 of the disk 556 and may serve as legs that are used to support and anchor the disk 556 (as shown in FIG. 5F) and prevent it from rotating within the polymer material of first wall 520. Alternatively, the metallic plate 555 may be a ring, such as ring 557, having a plurality of protrusions 545 along a first planar surface.

Figure 5G:
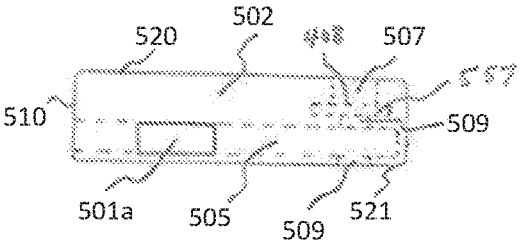
FIG. 5G shows a side view of another example key cover in accordance with example embodiments of the present disclosure.
Figure 5H:
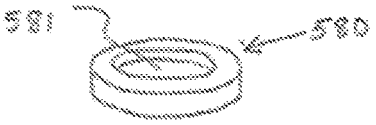
FIG. 5H shows a perspective view of a ring magnet suitable for insertion in an example key cover.
Figure 5I:
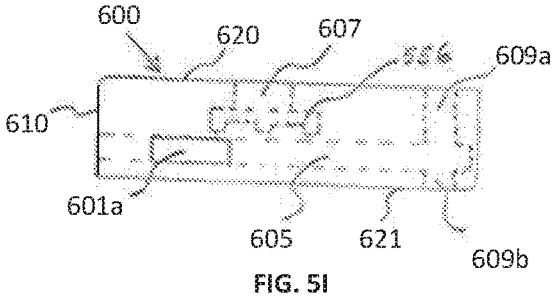
FIG. 5I shows a side view of another example key cover in accordance with example embodiments of the present disclosure.

In some embodiments, the cavity 507 may be in alignment with the key ring aperture 509 of the key cover 500. That is, as shown in FIG. 5G, the key ring aperture 509 may overlap with the cavity 507 such that a through-hole, which extends through the first wall 520 and the second wall 521, is provided. In such embodiments, the metallic plate 555 may be a ring, such as ring 557 (FIG. 5H), and a ring magnet (e.g. magnet 580 defining a central hole 581) may be installed in the cavity 507, accommodating passage of a key ring through the key ring aperture 509. In particular, the magnet 580 and metallic ring 557 may be arranged to align the hole 581 with the hole defined on the ring 557. In FIG. 5I, the cavity 607 does not align with the key ring apertures 609*a* and 609*b*. The metallic plate 556 is embedded in the first wall 620 between the cavity 607 and the interior surface of the first wall 620. The cavity 607 and metallic plate 556 are both positioned between the key ring apertures 609*a* and base rim 610 of key cover 600.

Figure 6:
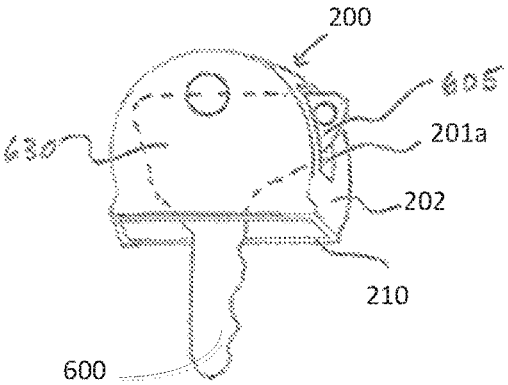
FIG. 6 shows a perspective view of a non-symmetrical key inserted in an example key cover.

Embodiments of the present disclosure may be suitable for use with large head keys, keys having plastic-covered bows or bows formed with and having a plastic body, automotive transponder keys, heavy equipment keys, tractors keys, key fobs, and non-symmetrical keys, such as key 600 shown in FIG. 6. The key 600 has a non-symmetrical key bow 630, such as those found on some motorized equipment ignition keys. An extended singular bow tip 605 is received through the slot 201*a*, thereby limiting bulk of the key cover 200 and still allowing for a tight friction fit for common shaped key bows.

In some embodiments, the key cover 200 may include RFID transponder(s) embedded within the walls of the key cover 200 and at least one activation/command button for automotive and motorized equipment applications, and for operating electronic doors (e.g. garage doors, entrance doors, etc.). In some embodiments, the key cover 200 may include, in at least one of its walls, an embedded battery and a function button, both of which are suitably wired within the key cover body to activate a light emitting diode located on a base rim of the key cover 200.

Figure 7:
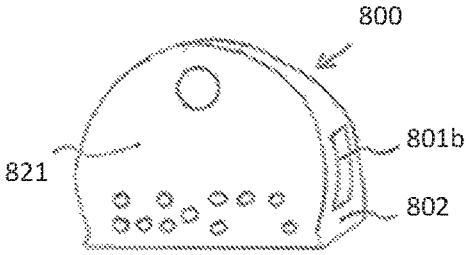
FIG. 7 shows a perspective view of another example key cover in accordance with example embodiments of the present disclosure.

FIG. 7 illustrates a further embodiment of the present disclosure in which a key cover 800 includes a plurality of raised projections extending outwardly from an exterior surface of one or more of its walls. The raised projections may be arranged in a pattern corresponding to one or more Braille characters, to assist with tactile recognition of the specific key covered by the key cover 800.

The various embodiments presented above are merely examples and are in no way meant to limit the scope of this application. Variations of the innovations described herein will be apparent to persons of ordinary skill in the art, such variations being within the intended scope of the present application. In particular, features from one or more of the above-described example embodiments may be selected to create alternative example embodiments including a sub-combination of features which may not be explicitly described above. In addition, features from one or more of the above-described example embodiments may be selected and combined to create alternative example embodiments including a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

The invention claimed is:

1. A cover for a key, comprising:

a first wall;

a second wall opposite to the first wall; and a continuous outer wall extending between the first wall and the second wall, the outer wall containing a pair of closed slots extending therethrough, the closed slots being positioned opposite to each other on the outer wall, wherein the closed slots are sized to interlock with lateral bow tips of an SC1 key, wherein the first wall, the second wall, and the outer wall define a closed chamber and an opening to the closed chamber formed at respective ends of the outer wall, and wherein the closed slots are spaced apart from respective ends of the outer wall adjacent the opening.

2. The cover of claim 1, wherein the closed slots are positioned on opposite sides of a plane which extends orthogonally through the first and second walls and which bisects the outer wall.

3. The cover of claim 1, wherein a height of at least one of the closed slots is between 4 and 5 millimeters.

4. The cover of claim 1, wherein the cover is a non-hinged cover.

5. The cover of claim 1, wherein the cover is adapted to hold the key by secure friction fit.

6. The cover of claim 1, wherein a side edge of the first wall, a second side edge of the second wall, and end surfaces of the outer wall together form a rim which defines the opening.

7. The cover of claim 1, wherein a length of the opening is between 15 millimeters and 40 millimeters.

8. The cover of claim 1, wherein the first wall defines a first cavity extending partially from an exterior surface of the first wall to an opposite interior surface of the first wall.

9. The cover of claim 8, wherein the first cavity is cylindrical.

10. The cover of claim 8, further comprising a first magnet inserted in the first cavity.

11. The cover of claim 10, wherein the first magnet is a ring magnet.

12. The cover of claim 10, wherein the first magnet is a disk magnet.

13. The cover of claim 8, wherein the first wall defines a first key ring aperture extending therethrough and the second wall defines a second key ring aperture extending therethrough, the first key ring aperture being in alignment with the second key ring aperture.

14. The cover of claim 1, wherein the second wall defines a second cavity extending partially from an exterior surface of the second wall to an opposite interior surface of the second wall.

15. The cover of claim 14, further comprising a second magnet inserted in the second cavity.

16. The cover of claim 1, wherein the closed slots are rectangular slits.

17. The cover of claim 1, wherein the closed slots are sized to interlock with lateral bow tips of an SC1 key having lateral bow tips of approximately 2 millimeters in length.

18. The cover of claim 1, wherein the opening to the closed chamber is for receiving a bow of the key to insert the key in the cover, and once inserted, to allow for protrusion of a blade of the key from the cover.

19. The cover of claim 18, wherein the cover is constructed from rubber.

* * * * *